United States Patent [19]

Carper

[11] Patent Number: 4,944,566

[45] Date of Patent: Jul. 31, 1990

[54] REFRIGERATOR SHELF ACCESSORY MOUNTING SYSTEM

[75] Inventor: Dwight A. Carper, Lincoln Township, Berrien County, Mich.

[73] Assignee: Whirlpool Corporation, Benton Harbor, Mich.

[21] Appl. No.: 294,370

[22] Filed: Jan. 9, 1989

[51] Int. Cl.[5] ..... A47B 88/00

[52] U.S. Cl. ..... 312/311; 312/246

[58] Field of Search ..... 108/26; 248/224.4, 225.1, 248/309.1; 312/245, 311, 246, 345

[56] References Cited

U.S. PATENT DOCUMENTS

| | | | |
|---|---|---|---|
| 1,143,297 | 6/1915 | Moore et al. | 312/345 |
| 1,527,282 | 2/1925 | Steadman | 312/246 X |
| 1,774,312 | 8/1930 | Braeutigam . | |
| 1,830,044 | 11/1931 | Vandoren . | |
| 2,065,391 | 12/1936 | Nance . | |
| 2,181,858 | 12/1939 | Anderson . | |
| 2,202,803 | 5/1940 | Rundell | 312/345 |
| 2,330,044 | 9/1943 | Gaston . | |
| 2,386,150 | 10/1945 | Swedman . | |
| 2,403,164 | 7/1946 | Ahrens et al. . | |
| 2,825,617 | 3/1958 | Morgan . | |
| 3,063,772 | 11/1962 | Kennedy . | |
| 3,107,959 | 10/1963 | Maxwell, Jr. . | |
| 3,108,455 | 10/1963 | Hanson . | |
| 3,241,334 | 3/1966 | Amore . | |
| 3,256,053 | 6/1966 | Levenberg | 312/245 |
| 4,241,668 | 12/1980 | Carroll | 108/26 |
| 4,528,825 | 7/1985 | Kahn . | |
| 4,717,102 | 1/1988 | Pflieger | 312/245 |
| 4,775,201 | 10/1988 | Thomson . | |
| 4,792,195 | 12/1988 | Adriaansen et al. | 312/245 |

*Primary Examiner*—Joseph Falk

*Attorney, Agent, or Firm*—Wood, Phillips, Mason, Recktenwald & Vansanten

[57] ABSTRACT

A refrigeration apparatus accessory storage system is provided for mounting to a refrigeration apparatus shelf. The system includes a storage accessory for storing items to be refrigerated. Means are included for attaching the storage accessory to the shelf comprising a bracket having an adjustable base portion for engagement with the storage accessory and a connector portion for attaching the bracket to the shelf.

14 Claims, 4 Drawing Sheets

FIG. 4
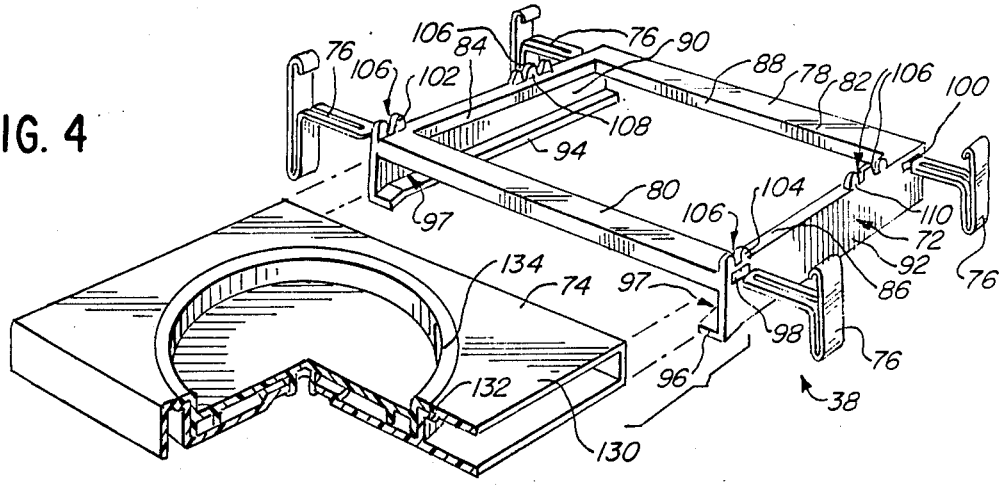
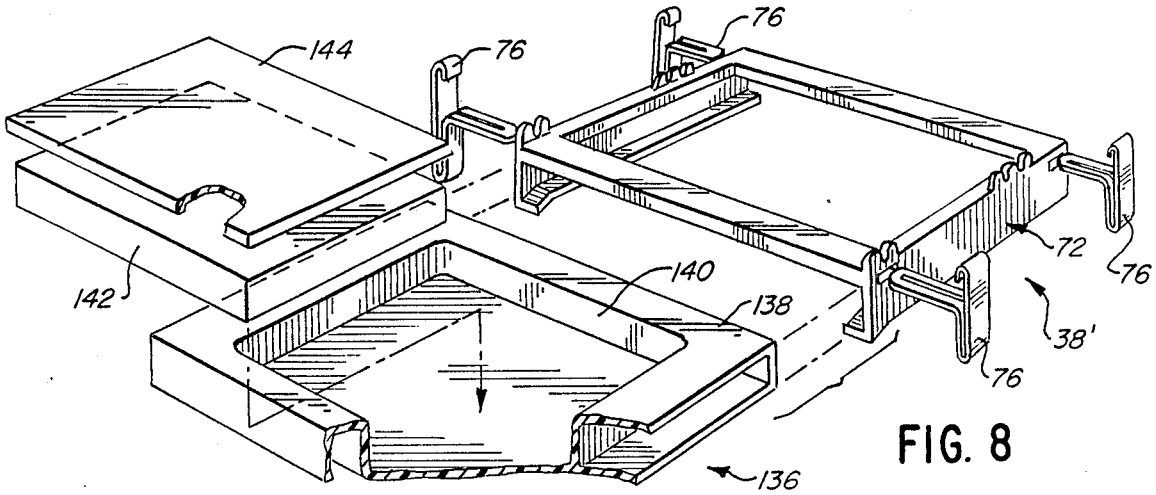
FIG. 8
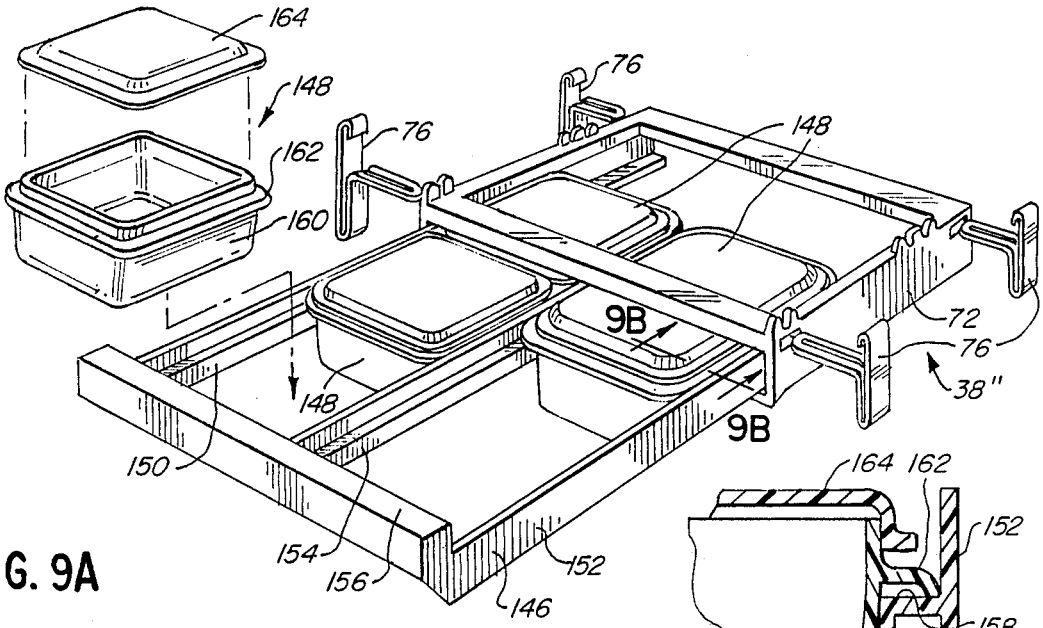
FIG. 9A
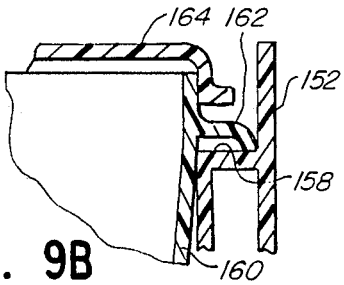
FIG. 9B

FIG. 10
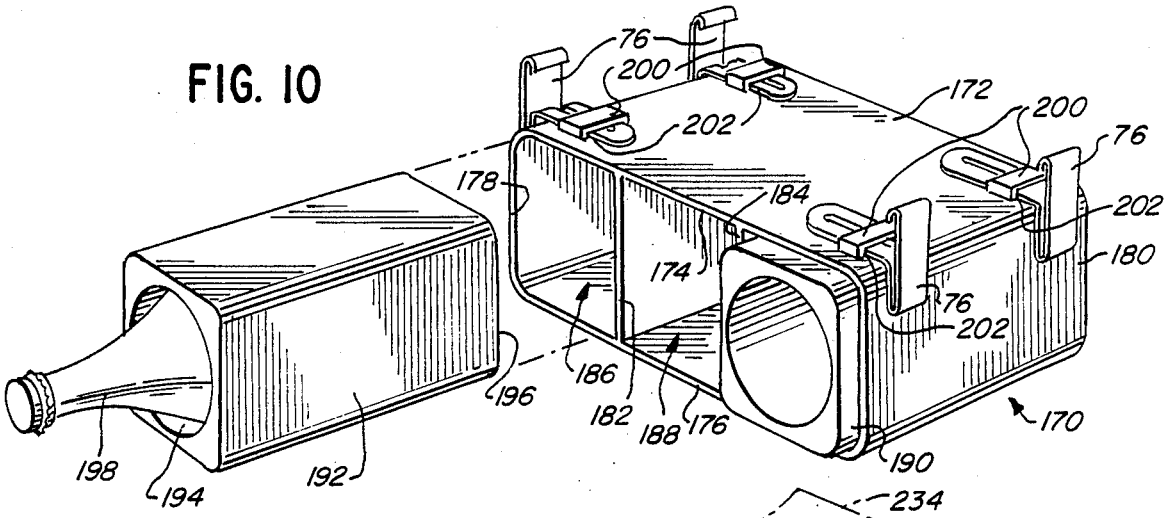
FIG. 11
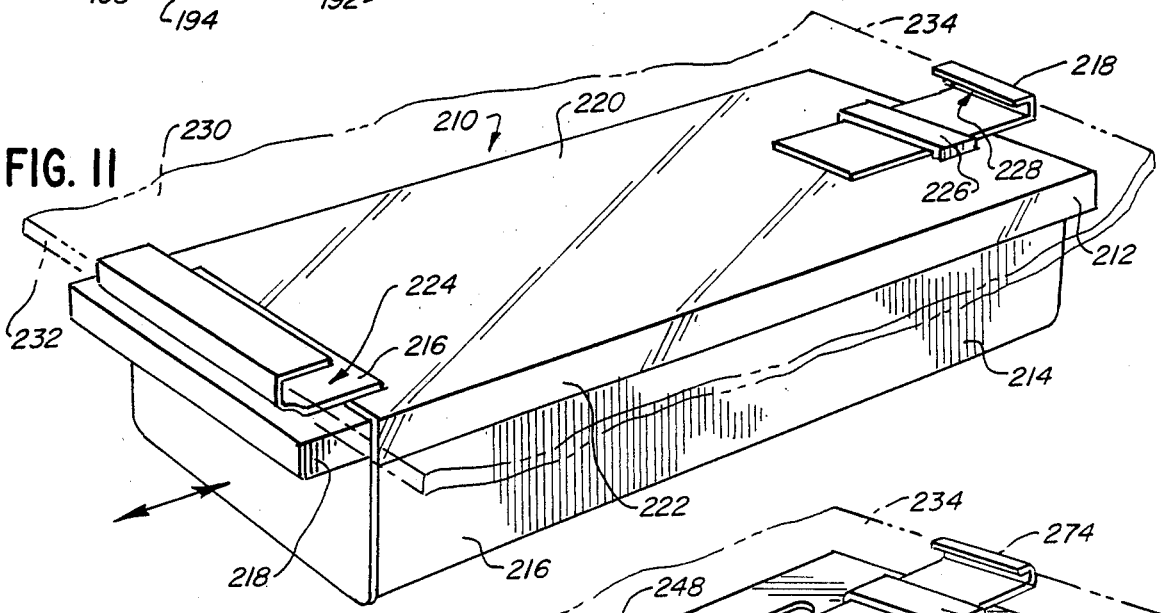
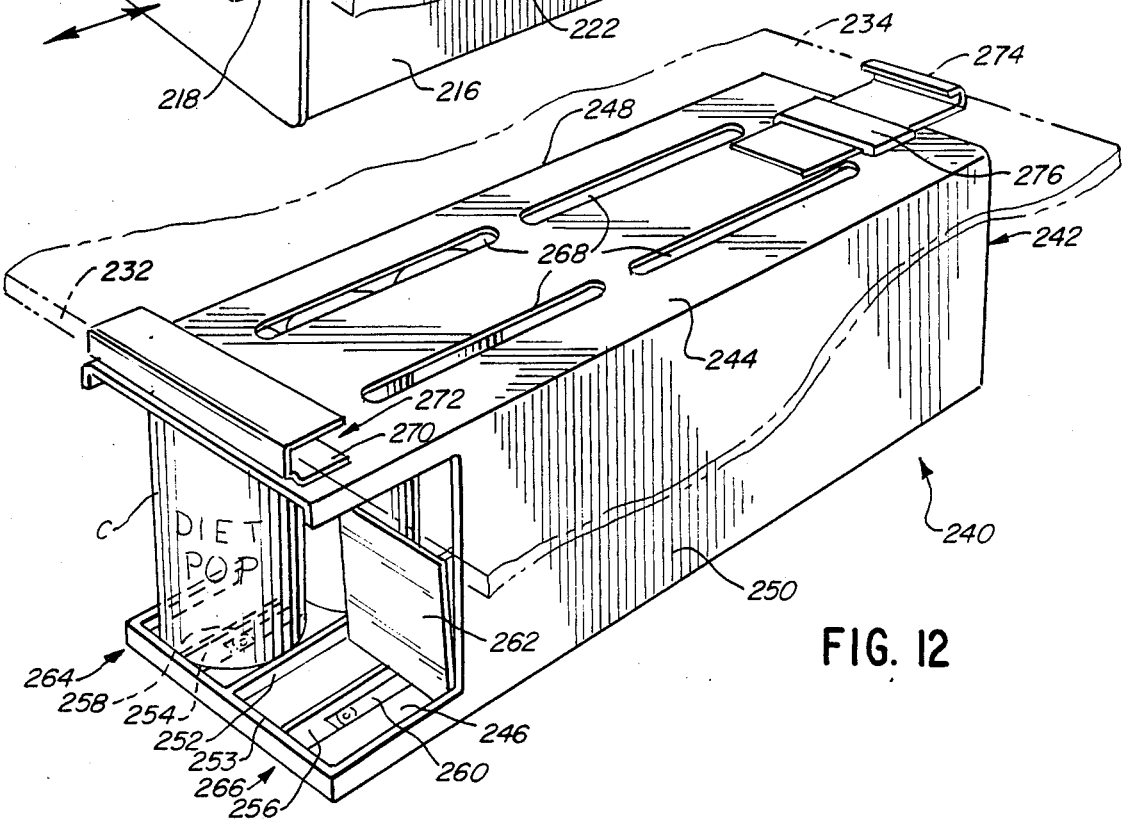
FIG. 12

REFRIGERATOR SHELF ACCESSORY MOUNTING SYSTEM

BACKGROUND OF THE INVENTION

1. Field of the Invention

This invention relates generally to a refrigeration apparatus and more particularly to a refrigerator shelf accessory mounting system.

2. Description of Background Art

A typical refrigeration apparatus, such as a refrigerator/freezer, includes one or more refrigerated compartments. The compartments include a plurality of shelves, which shelves may be stationary or selectively positionable, as is well known. The spacing above each shelf must be sufficient so that food products and containers of various sizes can be placed thereon without interference. This factor limits the number of shelves which can be provided and therefore the amount of available shelf space. An additional problem relates to the fact that articles which collect towards the rear of each shelf may not be readily accessible. Instead, the articles or containers stored in the front of the shelf tend to interfere with access to the rear of the shelf.

Nance U.S. Pat. No. 2,065,391 discloses a sliding shelf structure which is slidably secured below a stationary refrigerator shelf. Such a sliding shelf structure is believed deficient in that it must be custom manufactured along with the stationary shelf to provide the sliding relationship. Therefore, such an assembly would likely only be practical as an original equipment manufactured item.

Amore U.S. Pat. No. 3,241,334 discloses a meat storage receptacle assembly which can be sold as an accessory kit. The assembly can be moved to accommodate placement in different locations along the width of a refrigerator shelf. However, the assembly can only be utilized with wire shelves, specifically wire shelves including a back wire rail. Moreover, the position of the apparatus cannot be adjusted in a forward and reverse direction, but only side-to-side.

The present invention is intended to overcome one or more of the problems as set forth above.

SUMMARY OF THE INVENTION

In accordance with the present invention, a refrigeration apparatus accessory storage system is provided which may be adjustably mounted to a refrigeration apparatus shelf.

Broadly, there is disclosed herein a refrigeration apparatus accessory storage system for mounting to a refrigeration apparatus shelf. The system includes a storage accessory for storing items to be refrigerated. Means are included for attaching the storage accessory to the shelf comprising a bracket having an adjustable base portion for engagement with the storage accessory and a connector portion for attaching the bracket to the shelf.

According to one embodiment of the invention, a mounting rack or frame includes an upper rectangular frame portion provided with four slots, two on each side. The frame also includes opposite depending side walls with in-turned lower edges forming inwardly opening channels on each side of the frame. A storage container is slidably mountable in the frame between the channels. A plurality of mounting clips are provided, one for each slot. Each clip includes a horizontally extending base portion which is slidably received in the slot and an upstanding hook portion which hooks over the side of a shelf bracket to support the frame below a refrigerator shelf. Specifically, each of the clips can be slidably adjusted within its respective associated slot to vary the side-to-side position of the frame as well as to accommodate shelves of different width.

It is a feature of the present invention to provide a storage accessory comprising a storage pan slidably received in the frame channels.

It is another feature of the invention to provide a storage accessory comprising a support member carrying a rotatable tray and wherein the frame channels includes means for slidably receiving the support member.

It is still another feature of the invention to provide a storage accessory comprising a support member carrying a cooling tray and wherein the frame channels includes means for slidably receiving the support member.

It is still a further feature of the invention to provide a storage accessory comprising a plurality of food storage containers and a container support frame for holding the containers and wherein the frame channels include means for slidably receiving the container support frame.

It is a further feature of the invention to provide a frame including a plurality of guide members co-acting with a support rod on a shelf for providing a predetermined front to rear position of the frame.

It is yet another feature of the invention to provide a plurality of guide members for selectively providing a plurality of front to rear positions of the frame.

According to another embodiment of the invention, a food storage accessory system comprises an elongated upper rectangular frame portion. First and second mounting clips are mounted to the front and rear, respectively, of the frame portion. At least one of the brackets is slidably mounted in a slot to provide for front to rear adjustment when the frame is mounted to a shelf as by affixing the brackets to the front and rear of a shelf to support the frame below the shelf.

It is a feature of the invention that the shelf accessory comprises a beverage can support which includes biasing means for urging the beverage cans in a forward direction.

It is still another feature of the invention that the storage accessory comprises a storage pan and said frame includes supporting means for slidably receiving the storage pan.

Further features and advantages of the invention will readily be apparent from the specification and from the drawings.

BRIEF DESCRIPTION OF THE DRAWINGS

FIG. 4 is a perspective partially cut away exploded view of a rotatable tray shelf accessory according to the invention;

FIG. 8 is a perspective partially cut away exploded view of a shelf accessory comprising a cooling tray;

FIG. 9*a* is a perspective, exploded view illustrating a container food storage accessory system according to the invention;

FIG. 9*b* is a view taken along the line 9*b*–9*b* of FIG. 9*a*;

FIG. 10 is a perspective view of a shelf storage accessory system for beverage containers according to the invention;

FIG. 11 is a perspective view of a storage pan accessory according to an alternative embodiment of the invention; and FIG. 12 is a perspective view of a beverage can holder accessory system according to the alternative embodiment of the invention.

DETAILED DESCRIPTION OF THE INVENTION

Figure 1:
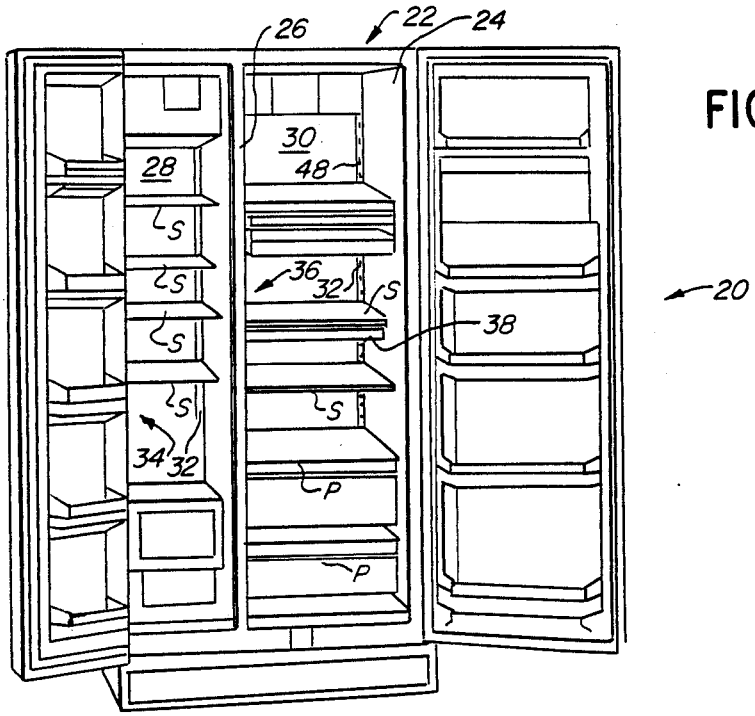
FIG. 1 is a perspective view illustrating a refrigeration apparatus including the shelf accessory system according to the present invention.

Referring to FIG. 1, a refrigeration apparatus, such as a refrigerator/freezer 20, includes a shelf accessory mounting system according to the present invention. The system is shown utilized with a side-by-side refrigerator/freezer; however, other types of refrigeration apparatus may be used in conjunction with the shelf accessory mounting system of the present invention, as will be obvious to those skilled in the art.

The refrigerator/freezer 20 includes a cabinet 22 provided with an internal liner 24 and an insulating separator or divider wall 26 to provide a below-freezing, or freezer, compartment 28 and a fresh food, or above-freezing, compartment 30. Each of the compartments 28 and 30 comprises a storage space including selected shelves S and storage pans P, as is well known. The shelves S and storage pans P are shown mounted to elongated, vertical bracket ladders or standards 32. Specifically, the standards 32 are affixed in any known manner to a rear wall 34 of the freezer compartment 28 and to a rear wall 36 of the fresh food compartment 30. Each standard 32 includes longitudinally extending and longitudinally spaced slots 48, as is well known.

Supported below one of the shelves S is an accessory system 38 according to the invention. The accessory system 38 may take one of a plurality of different forms, as described more specifically below.

The shelf accessory system 38 is particularly adapted for mounting to various different types of shelves. One example is a glass shelf 40 illustrated in FIG. 2. Another example is a wire shelf 42 illustrated in FIG. 3.

Figure 2:
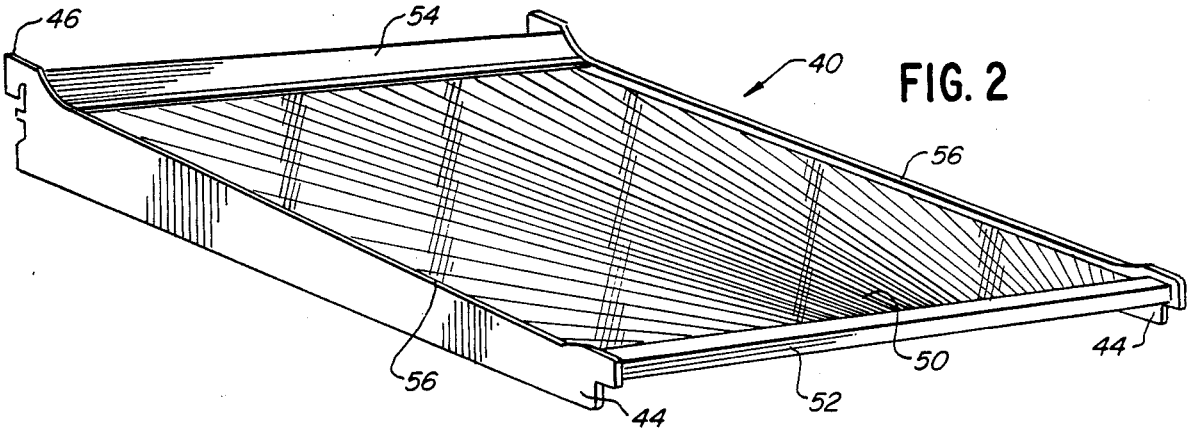
FIG. 2 is a perspective view of a glass shelf.

Referring first to FIG. 2, the glass shelf 40 includes parallel, opposite side brackets 44. The rear of each bracket 44 includes hooks 46 which may be retained within corresponding slots 48 in the standards 32. A glass plate 50 is retained to the brackets 44 at front and rear trim strips 52 and 54, respectively. Specifically, the glass plate 50 may be mounted in any known manner and is such that the top surface of the glass plate 50 is positioned slightly below an upper edge 56 of each bracket 44.

Figure 3:
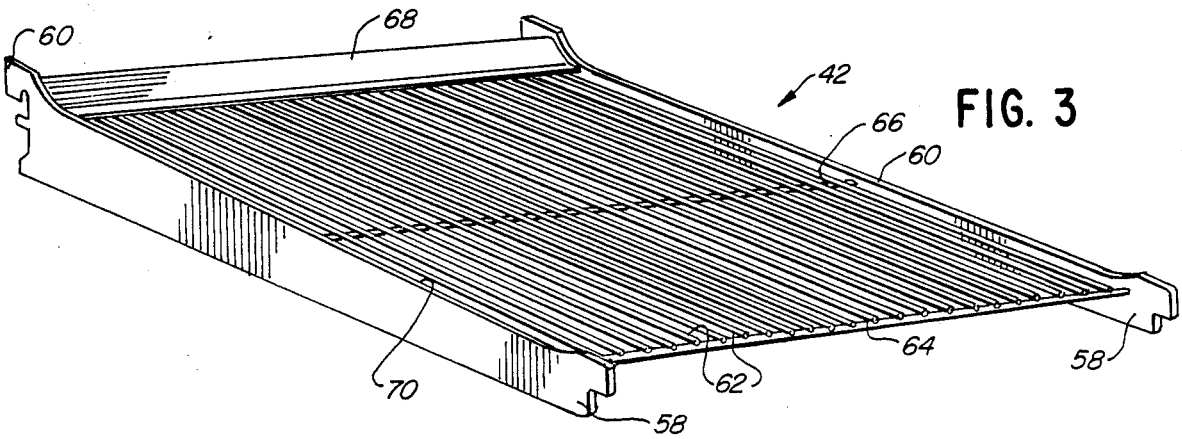
FIG. 3 is a perspective view of a wire shelf.

Referring now to FIG. 3, the wire shelf 42 includes parallel, opposite side brackets 58, similar to the brackets 44, above, including rear hooks 60. The shelf 42 further includes a plurality of parallel, spaced wire rods 62 extending parallel to the brackets 58. The rods 62 are welded or otherwise secured to a front cross rod 64, a central cross rod 66, and a rear trim piece 68, as is well known. As above, each bracket 58 includes a top edge 70 which is spaced slightly above the rods 62.

Referring to FIG. 4, the shelf accessory system 38 according to one embodiment comprises a rotatable tray accessory which includes a frame 72, a rotatable tray assembly 74, and four mounting clips or brackets 76.

The frame 72 includes an upper rectangular frame portion 78 having front and rear downwardly opening U-shaped channel portions 80 and 82, respectively, connected by opposite side portions 84 and 86, defining a rectangular opening 88. Opposite side walls 90 and 92 depend from the upper frame side portions 84 and 86, respectively. The side walls 90 and 92 are provided with in-turned lower edges 94 and 96, respectively, forming tracks or channels 97 on each side of the frame 72 to slidably receive and support the rotatable tray 74.

Respective front and rear slots 98 and 100 are provided through the side wall 92 and are in alignment with the channels of the upper frame channel portions 80 and 82. Similar slots (not shown) are provided through the opposite side wall 90 also in alignment with the channel portions.

Extending upwardly from the side walls 90 and 92 and aligned with the front channel portion 80 are respective tabs 102 and 104. Each tab 102 and 104 includes a U-shaped slot 106. Similarly, upwardly extending from the side walls 90 and 92, between the front and rear channel portions 80 and 82 are respective tabs 108 and 110. Each tab 108 and 110 includes two U-shaped slots 106.

The frame 72 may advantageously be formed of plastic or other similar material and may be of various colors to coincide with the color of the liner 24 or such other color as may be desired.

Figure 5:
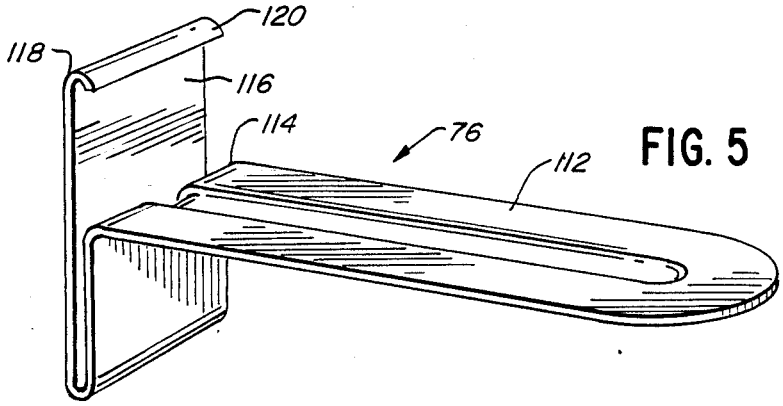
FIG. 5 is a perspective view of a mounting clip for the shelf accessory system of FIG. 4.

Referring to FIG. 5, the clip 76 includes a horizontally extending base portion 112 connected at a turned portion 114 to a J-shaped portion 116. An upper end 118 of the J-shaped portion 116 is turned inwardly and downwardly to provide a hook 120.

Figure 6:
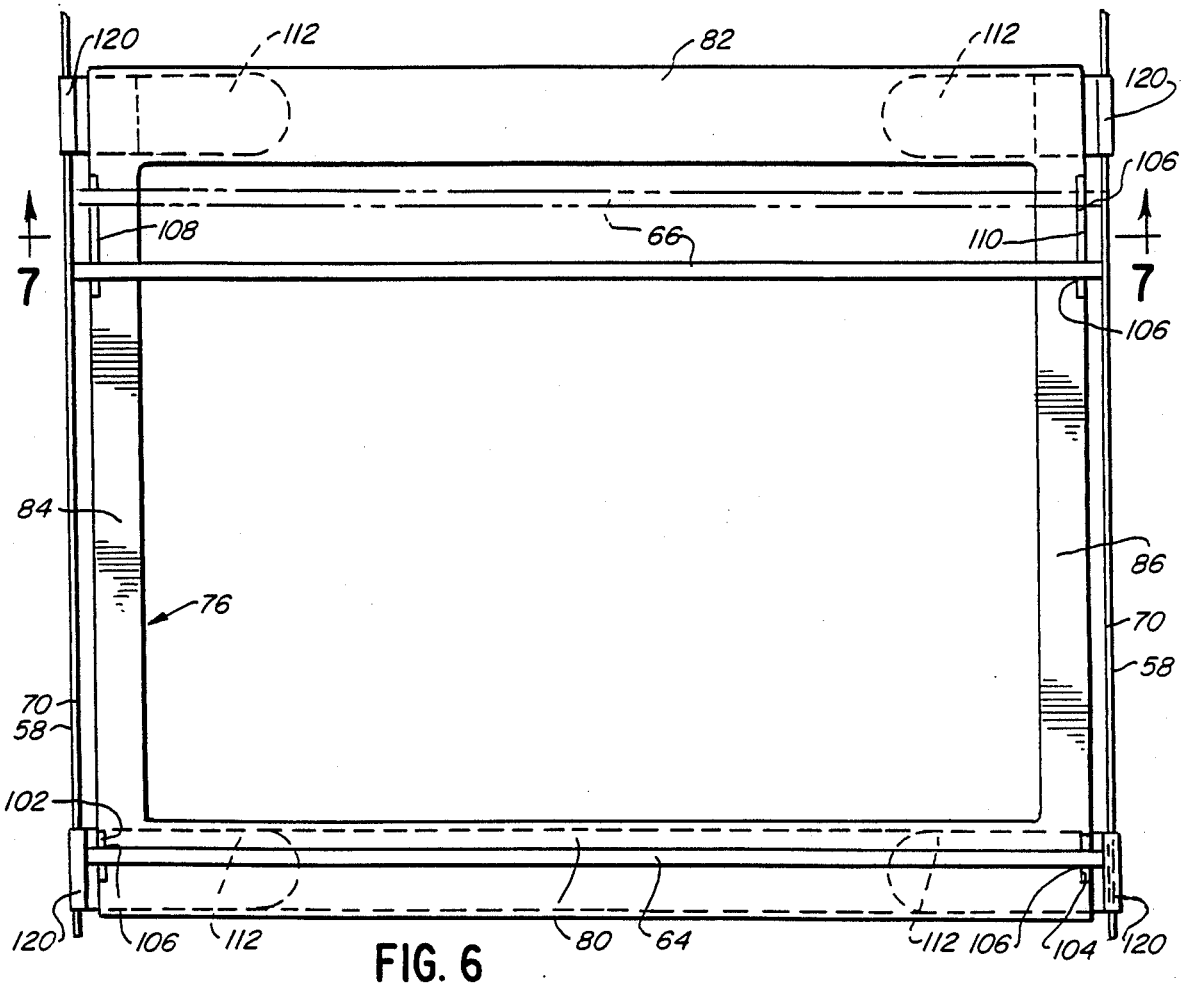
FIG. 6 is a plan view of a shelf supporting a frame for a shelf accessory system according to the invention, the wire or glass being removed for clarity.
Figure 7:
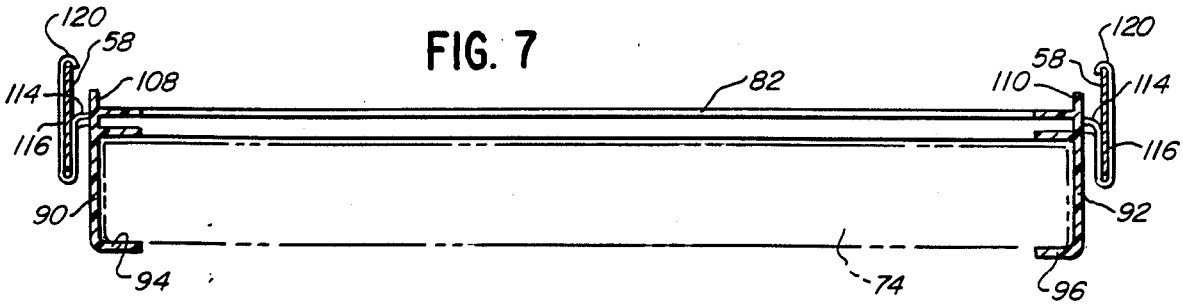
FIG. 7 is a sectional view taken along the line 7—7 of FIG. 6.

Referring also to FIGS. 6 and 7, the shelf accessory system 38 is shown mounted to a shelf, such as the shelf 42 of FIG. 3, with the parallel rods 62 removed for clarity.

Specifically, each of the clips 76 is slidably received in a slot, such as the slots 98 and 100, see FIG. 4. In fact, the base portion 112 of each clip extends through the slot into the respective associated front or rear channel 80 and 82. The clips 76 are mounted to the shelf 42 as by hanging the hook 120 of each clip 76 over one of the shelf brackets 58 with the hook 120 resting on the top edge 70 of the bracket 58. Also, the J-shaped portion 116 is adapted to extend downwardly on the outer side of the bracket and upwardly on the inner side of the bracket.

According to the invention, each of the clips 76 can be slidably received in one of the channel portions 80 or 82 a distance determined in accordance with the spacing between the shelf brackets 58. Thus, the clips 76 can be positioned to accommodate various width shelves by selectively extending more or less of the base portion 112 into the channels 80 and 82.

Although the base portion 112 of each clip is shown as being relatively short relative to the total length of each of the channel portions 80 and 82, the base portions 112 could be further extended to be up to one-half of the total length of such channel portions 80 and 82.

In accordance with the above, the frame 72 can be adjustably positioned from front to rear on the brackets 58. Advantageously, the U-shaped slots 106 of the front tabs 102 and 104 are adapted to receive the shelf front cross rod 64. Similarly, the U-shaped slots 106 of the rear tabs 108 and 110 are adapted to receive a central cross rod 66. Specifically, the rear tabs 108 and 110 are provided with a pair of U-shaped slots 106 so that the frame 76 can accommodate various different locations for the central cross rod 66. For example, on commercially available shelves the cross rod 66 may be spaced a relatively short distance from the front cross rod 64, as indicated in the solid line in FIG. 6, or may be spaced a further distance, as indicated by dashed lines in FIG. 6.

Referring again to FIG. 4, according to one embodiment of the invention, the rotatable tray assembly 74 comprises a rectangular shaped support member 130 of a size and shape to be received in the channels 97. The support member 130 includes a central circular terraced cavity 132 receiving a circular rotatable plate 134. The rotatable tray assembly 74 is commonly referred to as a lazy-susan rotating tray. Ideally, food items may be stored in the plate 134 for simple removal when serving is desired with the food items being readily available.

Referring to FIG. 8, a storage accessory system 38' according to an alternative embodiment of the invention is illustrated. The accessory system 38' includes a frame 72 and clips 76 similar to those discussed above. A storage accessory in the form of a cooling tray assembly 136 is receivable in the frame 72.

The cooling tray assembly 136 includes a rectangular-shaped support member 138, similar in size and shape to the support 130 of FIG. 4, except that a rectangular-shaped cavity 140 is provided therein. The cavity 140 may be used for storing food items for serving. Alternatively, the cavity 140 is adapted to receive a gelatin freezing pack 142 and a cover 144. Specifically, the gelatin freezer pack 142 may be placed in either the freezer compartment 28 or fresh food compartment 30 prior to use, and subsequently be placed in the cavity 140 and covered by the cover 144 to act as a serving tray for food items which require continual chilling. The pack 142 serves the function of an ice block to maintain the chilled temperature of food items placed on the cover 144.

Referring to FIG. 9, a shelf accessory system 38" according to still another embodiment of the invention is illustrated. The storage accessory system 38" includes a frame 72 and mounting clip 76 similar to those discussed above. The accessory storage system 38" also includes a food storage rack 146 and a plurality of covered food storage containers 148.

The food storage rack 146 includes opposite side walls 150 and 152 and a central wall 154 connected by a front handle 156 and a rear wall (not shown). The spacing between the side walls 150 and 152 corresponds to the spacing between the channels 97 of the frame 72 so that the storage rack 146 is slidably received therein. Each of the walls 150, 152 and 154 is provided with shoulder portions, illustrated in the detailed sectional view of FIG. 9 at 158. Each container 148 comprises a food container which may be of various size having an outwardly extending flange 162 which rests on the shoulder 158 to support the same. A cover 164 is mountable to the containers 160 in any known manner. Preferably, the containers 148 are of the type which can be refrigerated, frozen, placed in a microwave oven and also placed in a conventional oven, within certain temperature limitations.

The containers 148 may be differing sizes. Preferably, the containers are of a size so that either two or three of such containers 148 can be placed on either side of the food storage rack 146.

Referring to FIG. 10, a food storage accessory system 170 according to a further embodiment of the invention is illustrated. The accessory system 170 includes a frame 172 having a top wall 174 and a bottom wall 176 connected by opposite side walls 178 and 180. First and second central walls 182 and 184 are parallel to and spaced between the opposite side walls 178 and 180. The top wall 172, side wall 178, bottom wall 176 and first central wall 182 define a first compartment 186; the top wall 172, first central wall 182, bottom wall 176 and second central wall 184 define a second compartment 188; while the top wall 172, second central wall 184, bottom wall 176 and second side wall 180 define a third compartment 190. Each of the compartments 186, 188 and 190 is of generally square shape and is adapted to receive a beverage support 192. The beverage support 192 has an outer shape corresponding to the shape of each of the compartments 186, 188 and 190, and a circular cavity extending therethrough and terminating in a bottom wall 196. A beverage container, such as a bottle 198, can be inserted into the cavity 194 for supporting same.

Four collar elements 200 are affixed to the frame top wall 172 adjacent the front and rear of each side wall 178 and 180. A slot 202 is formed between each collar element 200 and the top wall 172 for receiving a clip 76, as discussed above.

Thus, the frame 172 can be mounted below a shelf, in the manner discussed above, and beverage containers 198 stored in the beverage support 192 can be inserted in the respective compartments 186, 188 and 190 for cooling the same while taking up minimal shelf space. Particularly, such an accessory system 170 can solve problems caused by inadequate vertical space for supporting such containers 198 upright, while also preventing the containers 198 from rolling along a shelf S as is common when the are rested on their side.

Any of the shelf accessories 38, 38', 38" or 170 can be provided as an accessory for existing refrigerator/freezers, or as an item included at the time of manufacture.

Referring to FIG. 11, a food storage accessory 210 according to a further embodiment of the invention is illustrated.

The food storage accessory 210 includes a frame 212, a storage pan 214, a front mounting clip 216 and a rear mounting clip 218.

The frame 212 comprises a rectangular top wall 220 connecting downwardly extending opposite parallel side walls 222 having inwardly turned edges (not shown) defining a channel at either side. The storage pan 214 includes a storage receptacle 216 having a front handle 218. A flange (not shown) extends outwardly from the side walls of the receptacle 216. The flanges engage the channel for the frame 212 to slidably support the pan 214 below the frame 212.

The front clip 216 is generally U-shaped and is fixedly secured at the front of the frame top wall 220. The clip 216 defines a rearwardly opening channel 224. The rear clip 218 is J-shaped and is slidably received in a collar element 226 at the rear of the frame top wall 220. The clip 218 includes a frontwardly opening channel 228 facing the front clip channel 224.

The accessory 210 may be adjustably secured to a shelf indicated in phantom at 230. The shelf 230 includes a front edge 232 and a rear edge 234. As will be appreciated, the shelf 230 could be similar to the shelves 40 and 42 of FIGS. 2 and 3, respectively, or any other type shelf including such front and rear edges. The shelf accessory is mounted with the front clip channel 224 receiving the shelf front edge 232 and the rear clip channel 228 receiving the shelf rear edge 234. Specifically, the rear clip 218 can be slidably adjusted in the collar element 226 to adapt the frame 212 to fit shelves of a variety of different depths.

Although not shown, the frame 212 could alternatively be provided with front and rear adjustable clips or with a rear fixed clip and a front adjustable clip, as is obvious.

Thus, the shelf accessory 210 can be provided as an accessory for existing refrigerator/freezers, or as an item included at the time of manufacture.

Referring to FIG. 12, a shelf accessory system 240 according to yet a further embodiment of the invention is illustrated. The shelf accessory system 240 is adapted for supporting a plurality of beverage cans C and the like in a refrigerator/freezer.

The shelf accessory system 240 includes a frame 242 having a top wall 244 and a bottom wall 246 connected by opposite parallel side walls 248 and 250. The bottom Wall 246 includes an elongated central upwardly extending partition wall 252 connected to a front partition wall 253. First and second channels 254 and 256 are provided in the bottom wall 246 respectively between the first side wall 248 and the partition 252, and the partition 252 and the second side wall 250. Secured in each of the channels 254 and 256 is a respective wound spring 258 and 260. The second spring 260 is connected to the back of a biasing plate 262. A similar biasing plate (not shown) is connected to the first spring 258.

The accessory 240 is adaptable to receive a plurality of beverage cans in first and second compartments 264 and 266 associated with the respective channels 254 and 256. Specifically, the beverage cans are inserted between the front partition wall 253 and the biasing plates 262. As multiple beverage cans C are so placed, the biasing plate 262 is moved rearwardly against the force of the associated springs 258 and 260. Subsequently, as any cans C are removed, the biasing plates 262 under the force of the springs 258 and 260 force the remaining cans C in the forward direction for easy removal. The top wall 244 is provided with a plurality of elongated slots 268 for easy viewing of the number of cans C remaining in either compartment 264 or 266.

A U-shaped clip 270 is secured at the front of the top wall 244. The clip 270 includes a rearwardly opening channel 272 for receiving the front edge 232 of a shelf similar to that discussed above relative to FIG. 11. A J-shaped rear clip 274, similar to the clip 218 above, is received in a collar element 276 at the rear of the top wall 244. Thus, the shelf accessory 240 is adjustably mounted to a refrigerator shelf similarly to that described above relative to FIG. 11.

Thus, the invention broadly comprehends a shelf accessory system which is adjustably mounted to a refrigeration apparatus shelf.

The foregoing disclosure of the preferred embodiments is illustrative of the broad inventive concepts comprehended by the invention.

I claim:

1. A universal refrigeration apparatus accessory storage system adaptable for mounting to a refrigeration apparatus shelf of any selected width comprising:

a storage accessory for storing items to be refrigerated, said storage accessory including a frame defining opposite sides, each said side having an outwardly opening slot; and means for attaching said storage accessory to said shelf comprising a pair of brackets, each bracket having a base portion adapted to be slidably received in one of said slots and adjustably positioned relative to said storage accessory according to the selected width of the shelf, and a connector portion for attaching said bracket to the shelf.

2. The refrigeration apparatus accessory storage system of claim 1 wherein said bracket connector portions attach to opposite side portions of said shelf.

3. A universal food storage accessory system adaptable for mounting to a refrigeration apparatus shelf assembly having opposite side brackets mountable in a refrigeration apparatus compartment, a shelf, the side brackets being spaced according to a selected width of the shelf assembly, and means for securing said shelf to said brackets, comprising:

a storage accessory for storing items to be refrigerated;

a frame including means for supporting said storage accessory, said frame defining opposite sides, each said side having an outwardly opening slot; and means for attaching said frame to said shelf assembly comprising a pair of clips each having a base portion adapted to be slidably received in one of said slots and adjustably positioned according to the selected width of the shelf assembly, and a connector portion for hanging said clip from said shelf assembly.

4. The food storage accessory system of claim 3 wherein said clip connector portions include means for attaching said clip to one of said shelf assembly brackets.

5. The food storage accessory system of claim 3 wherein said frame supporting means includes means for slidably receiving said storage accessory.

6. The food storage accessory system of claim 3 wherein said storage accessory comprises a storage pan and said frame supporting means includes means for slidably receiving said storage pan.

7. The food storage accessory system of claim 3 wherein said storage accessory comprises a support member carrying a rotatable tray and said frame supporting means includes means for slidably receiving said support member.

8. The food storage accessory system of claim 3 wherein said storage accessory comprises a support member carrying a cooling tray and said frame supporting means includes means for slidably receiving said support member.

9. The food storage accessory system of claim 3 wherein said storage accessory comprises a plurality of beverage container bins and said frame supporting means includes means for slidably receiving said bins.

10. The food storage accessory system of claim 3 wherein said storage accessory comprises a plurality of food storage containers and a container support frame for holding said containers and said frame supporting means includes means for slidably receiving said container support frame.

11. The food storage accessory system of claim 3 wherein said storage accessory comprises a beverage can support.

12. The food storage accessory system of claim 11 wherein said beverage can support includes biasing means for urging beverage cans in a forward direction.

13. In a refrigeration apparatus having a cabinet including a refrigerated compartment, an accessory storage system comprising:

a shelf of a selected width mountable in said compartment, said selected width comprising any one of a plurality of different widths;

a storage accessory for storing items to be refrigerated, said storage accessory including a frame defining opposite sides, each said side having an outwardly opening slot; and means for attaching said storage accessory to said shelf comprising a pair of clips each having a base portion adapted to be slidably received in one of said slots and adjustably positioned relative to said storage accessory according to the selected width of said shelf and a connector portion for attaching said clip to said shelf.

14. The accessory storage system of claim 13 wherein said clip connector portions attach to opposite side portions of said shelf.

* * * * *